US007000858B2

(12) United States Patent
Li et al.

(10) Patent No.: US 7,000,858 B2
(45) Date of Patent: Feb. 21, 2006

(54) APPARATUS FOR PRODUCING FINE POWDER

(75) Inventors: Yi Li, Kowloon (HK); Weilin Xu, Kowloon (HK)

(73) Assignee: The Hong Kong Polytechnic University, Kowloon (HK)

( * ) Notice: Subject to any disclaimer, the term of this patent is extended or adjusted under 35 U.S.C. 154(b) by 141 days.

(21) Appl. No.: 10/354,170

(22) Filed: Jan. 30, 2003

(65) Prior Publication Data

US 2004/0164191 A1 Aug. 26, 2004

(51) Int. Cl.
*B02C 19/00* (2006.01)

(52) U.S. Cl. ..... 241/261.1

(58) Field of Classification Search ..... 241/261.1, 241/261.2, 261.3, 296, 297, 298, 257.1
See application file for complete search history.

(56) References Cited

U.S. PATENT DOCUMENTS

| | | | | |
|---|---|---|---|---|
| 3,910,511 | A * | 10/1975 | Leider et al. | 241/261.3 |
| 4,005,827 | A * | 2/1977 | Frair et al. | 241/261.3 |
| 4,930,708 | A * | 6/1990 | Chen | 241/65 |
| 5,042,726 | A * | 8/1991 | Reinhall | 241/28 |
| 5,249,734 | A * | 10/1993 | Pilao | 228/182 |
| 6,053,440 | A * | 4/2000 | LaRiviere | 241/46.01 |

FOREIGN PATENT DOCUMENTS

JP 63-116747 * 5/1988

* cited by examiner

*Primary Examiner*—Mark Rosenbaum
(74) *Attorney, Agent, or Firm*—Leydig, Voit & Mayer, Ltd.

(57) ABSTRACT

An apparatus for grinding an organic material into a powder includes a first grinding member with a first grinding surface and a second grinding member with a second grinding surface. The first and second grinding members are rotatably positioned adjacent each other for grinding an organic material between the first and second grinding surfaces. The first and second grinding surfaces include radii defining of sectors. The sectors include rows of teeth parallel to respective radii.

5 Claims, 5 Drawing Sheets

APPARATUS FOR PRODUCING FINE POWDER

BACKGROUND TO THE INVENTION

1. Field of the Invention

The present invention relates to the production of fine powders, and in particular to an apparatus for producing fine powder from organic material such as silk, wool and ramie.

2. Background Information

Organic materials such as silk, wool and ramie have special properties such as being high quality natural proteins, having moderate moisture absorption and retention properties and a high affinity with human skin. Such organic materials have been used, in powder form, in food products, beverages and cosmetic products. Also, method are known by which organic powders can be absorb into cotton fibers to produce fabrics which offer good drape characteristics as well as moisture-absorbing properties inherent in the cotton.

Organic materials such as silk and wool are widely used as high quality textile. Every year the textile industry produces large quantities of waste silk or wool fibers which cannot be used for textile processing. These fibers can be regenerated into organic powders. However, the process for doing this is messy problematic.

Compared with inorganic fiber, silk fibers, for example, not only have high strength but also high break intensity and high elongation, so they are very difficult grind into powder. Even when cut into short pieces the fibres still tends to wind together to form balls during grinding.

Presently, the best method of producing fine powder from silk is by chemical pretreatment to destroy its chemical bond and reduce its crystallinity. High energy irradiation can also be used to destroy the crystal structure. After pretreatment, the fibers are dissolved into an aqueous calcium chloride solution at high temperature, followed by a dialysis treatment to remove the salt; they are then dehydrated, dried and pulverized to yield a fine powder.

SUMMARY OF THE INVENTION

It is an object of the present invention to provide an apparatus for producing powder from organic fibers which ameliorates disadvantages with the prior art or at least provides the public with a useful alternative.

According to the invention there is provided an apparatus for grinding an organic material into a powder including:

a first grinding member with a first grinding surface, a second grinding member with a second grinding surface, the first and second grinding members rotatably positioned adjacent each other for grinding an organic material between the first and second grinding surfaces, the first and second grinding surfaces including a plurality of radii defining a plurality of sectors, the sectors provided with rows of teeth parallel to a respective radius.

Preferably, the first grinding surface is concave and the second grinding surface is convex.

Preferably, the first and second grinding surface are substantially conical or parabolic.

Preferably, the second member is engaged with a rotary driving means for rotation of the second grinding surface relative to the first grinding surface.

Preferably, the second grinding member has a passage through it.

Preferably, the apparatus further includes troughs between the rows of teeth defining chambers that increase and decrease in size with rotation of the second grinding member.

Further aspects of the invention will become apparent from the following description, which is given by way of example only.

BRIEF DESCRIPTION OF THE DRAWINGS

Embodiments of the invention will now be described with referable to the accompanying drawings in which.

DISCLOSURE OF INVENTION

Figure 1:
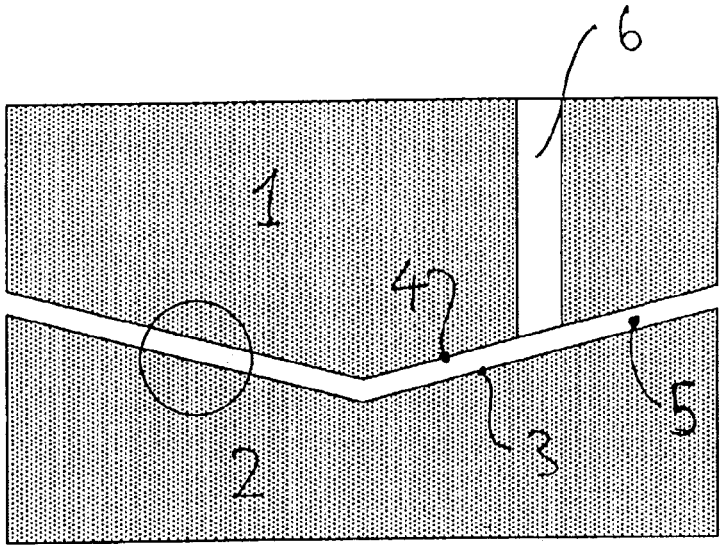
FIG. 1 illustrates a cross-section through an apparatus for grinding organic powder according to the invention.

FIGS. 1 to 4 illustrate an apparatus according to the invention. The apparatus comprises upper and lower circular grinding members 1, 2. Lower grinding member 2 has an upwardly facing grinding surface 3. The upwardly facing grinding surface 3 has a concave shape. In the preferred embodiment the concavity is conical, however in alternative embodiments it may be parabolic or any other suitable shape that curves inwards. Upper grinding member 2 has a downwardly, facing grinding surface 4. The downwardly facing grinding surface 4 has a convex shape to suitably match the concavity of upwardly facing grinding surface 3.

The upper and lower members 1,2 are disposed about a vertical axis A with the upper and lower grinding surfaces 4, 3 in close proximity for grinding a fibrous material in a grinding cavity 5 therebetween. In the preferred embodiment lower member 2 is fixedly disposed while upper member 1 is engaged with a rotary driving means (not shown) for rotation of upper grinding surface 4 relative to lower grinding surface 3. In alternative embodiments, however, upper member 1 may be held stationary and lower member 2 rotated, or both members 1, 2 may be counter-rotated for relative movement between upper and lower grinding surfaces 4, 3. A passage 6 through upper member 1 facilitates the introduction of material into grinding cavity 5.

Figure 2:
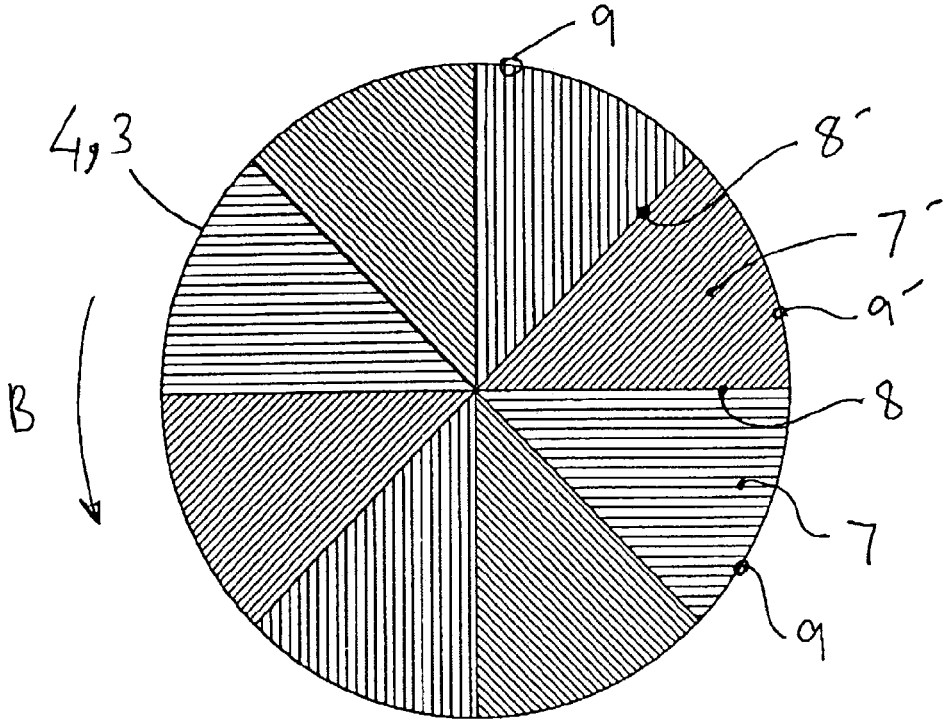
FIG. 2 illustrates a plan view of a grinding surface of the apparatus.

FIG. 2 illustrates a plan view of the grinding surfaces. Both the upper and lower grinding surfaces 4, 3 have the same structure. Rotation of upper member 1 rotates the upper grinding surface 4 in the direction of arrow B. In the case of lower grinding surface 3, arrow B is the 'effective' direction of rotation experienced by lower surface 3 as upper grinding surface 4 moves relative to it.

The circular grinding surfaces 3,4 are divided into a plurality of sectors 7. Each sector is associated with a radius 8 dividing it from an adjacent sector 7' rotationally forward of it. Each sector 7 has parallel rows of teeth 9 running parallel to its associated dividing radius 8. The teeth 9 in a sector 7 are at an acute angle to those in a sector 7' rotationally proceeding or forward of it.

Figure 3:
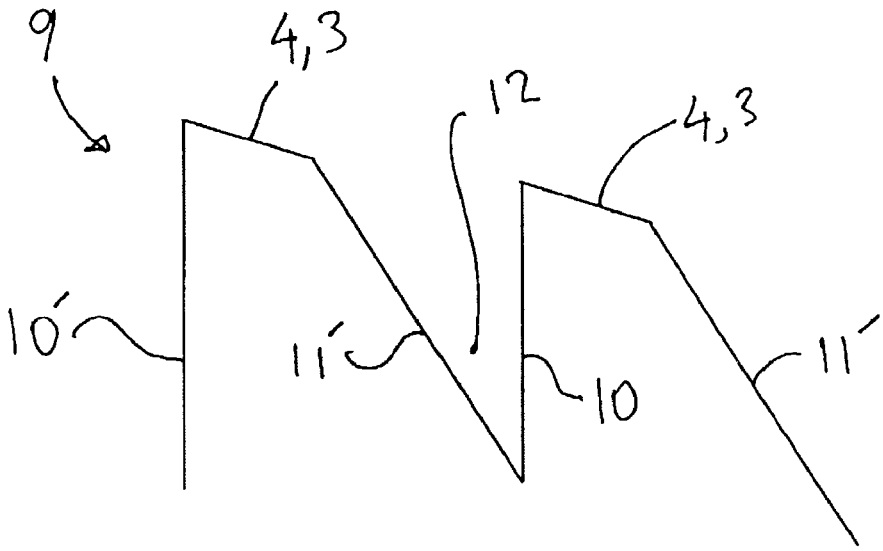
FIG. 3 illustrates a tooth of the grinding surface.

FIG. 3 illustrates a cross section through a portion of parallel teeth 9. Each tooth 9 has a vertical leading-edge 10 and an inclined trailing-edge 11 to providing a plurality of V shaped trenches 12 parallel to radius 8.

Figure 4:
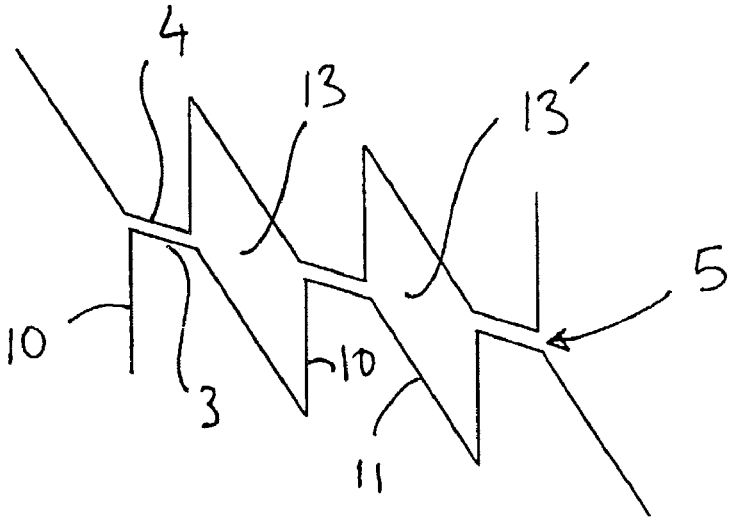
FIG. 4 illustrates the opposing grinding surfaces of the apparatus.

FIG. 4 illustrates the profile of grinding cavity 5 between the opposed rows of teeth 9 on upper grinding surface 4 and lower grinding surface 3. Opposing V shaped trenches 12 create a plurality of chambers 13 in cavity 15 which increase and decrease in size with rotation of upper grinding surface 4, in the direction of arrow B. This increase and decrease in the size of chambers 13 pulverizes organic fibers in the grinding cavity 5, quickly reducing them to a fine powder.

In the preferred embodiment the grinding surfaces 4,3 and teeth 9 are made of Aluminum. In alternative embodiments grinding surfaces 4,3 and teeth 9 are made of Tungsten Carbide or other materials with high abrasive durability and low heat generation.

To grind an organic material into fine powder the organic fibers are first cut into shorts lengths (circa 3 mm) using a rotary blade. The fibers are introduced into the grinding cavity 5 through passage 6. In the preferred example a caustic agent in solution is also introduced into the grinding cavity 5 to assist grinding. The concavity of lower grinding surface 3 retains the caustic solution keeping the cut fibers immersed during grinding. Upper grinding member 4 is rotated to pulverize the organic fibers into power.

Prior to grinding the fibers can also be pretreated. In the preferred embodiment a 0.5% Sodium Chlorate (NaClO) solution is used.

In alternative embodiments different pretreatment can be used before grinding. For example, silk fiber can be pretreated by with an alkaline aqueous solution at a temperature of 95 degrees Celsius or higher, preferably about 100 degrees Celsius. The alkaline aqueous solution, may be a solution of sodium carbonate, potassium carbonate, sodium hydroxide, potassium hydroxide or the like. The extent of alkalinity of the alkaline aqueous solution may be pH 11.5 or higher, but is preferably pH 12 or higher.

After pretreatment with the alkaline aqueous solution the silk fibers are washed, dried and ground.

The pulverization of the silk substance into fine powder can be conducted by a two-step process, in which the first step comprises dividing the silk substance into coarse powder and the second step comprises dividing it into fine powder. The pulverization of the silk substance into coarse powders is to yield powders having an average particle size ranging from approximately 15 to 30 microns. The pulverization of the course powders into finely divided powders is to yield powder having an average particle size less than 10 microns in diameter.

An example of organic fibers ground into fine powder will now be described. Wool fibers of around 25 $\mu$m diameter were cut into short pieces (around 3 mm) using a rotary blade. They were then pretreated in 0.5% NaClO solution at room temperature. After the excessive water was removed, the wool powder was ground in the apparatus without the addition of a caustic agent. Samples were ground for different time periods and samples taken.

Figure 5:
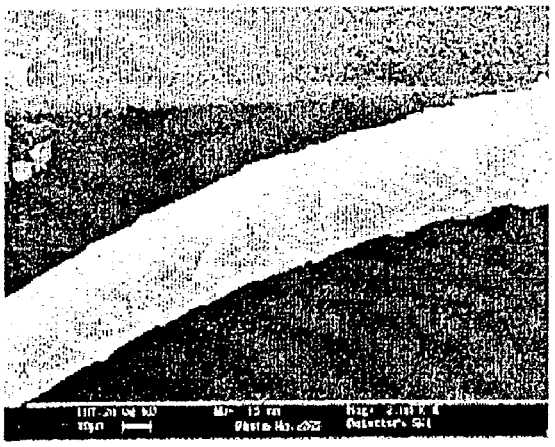
FIGS. 5, 6, and 7 are microscope views of organic fiber samples at different stages of grinding.

FIG. 5 shows sample #1 after grinding for 5 minutes. The fibers still have their original outline.

Figure 6:
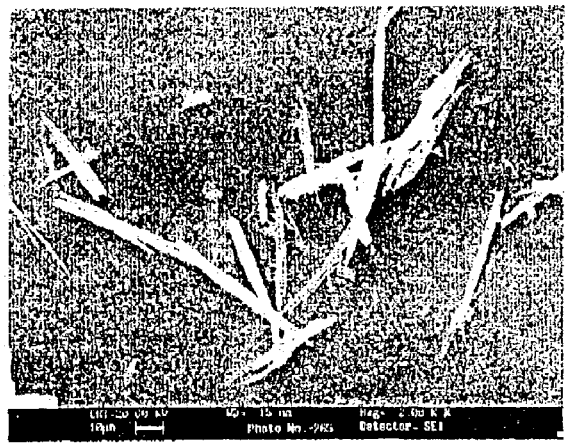

FIG. 6 shows sample #2 after grinding for 30 minutes. The fibers have begun to split into small pieces. At this stage the fibers has been destroyed in the amorphous region and some crystals have also been destroyed.

Figure 7:
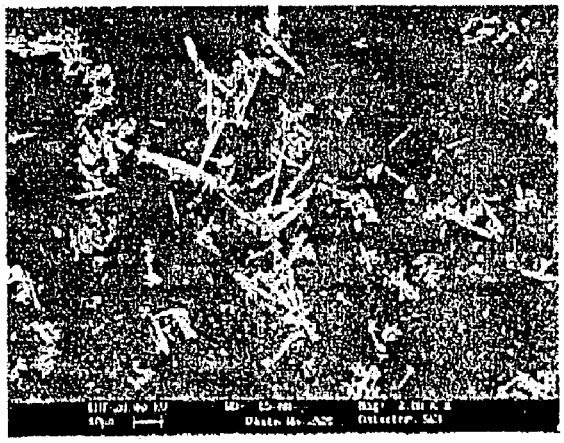

FIG. 7 shows sample #3 after grinding for 3 hours. The fibers has been crushed into very small pieces, especially in the diameter, with most pieces smaller than 2 $\mu$m. At this stage the pieces still have some properties similar to fibers, such as the orientation along the lengthwise, and there are some small crystals in the powder.

Figure 8:
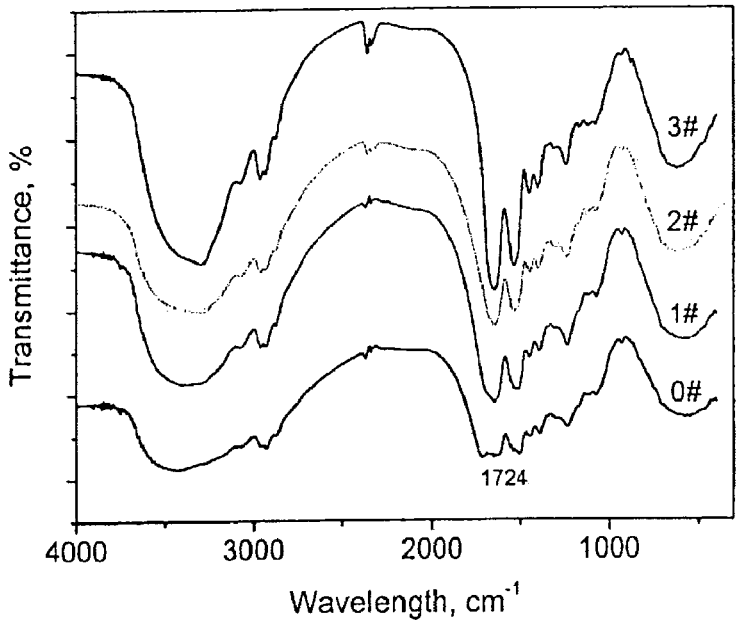
FIGS. 8 and 9 show graphical results of the grinding process.

FIG. 8 shows the Fourier Transformation, Infrared (FTIR) spectrum in the range of 400–4000 $cm^{-1}$. The initial fibers are sample #0. This illustrates that no new chemical bonds were produced in the fine powder. However, as the powder size decreased, the absorbing peak in 1620–1720 $cm^{-1}$ became more and more narrow, and in sample, 3# the absorbing peak reduced by only 1670–1660 $cm^{-1}$. This shows that some Ester bonds were destroyed during the processing. Mechanical action together with water and chemicals can lead to reconstruction of the crosslinks and some changes in the chemical structure. Disulfide bond reduction should increase the ease of elimination of some groups in the macromolecules.

Figure 9:
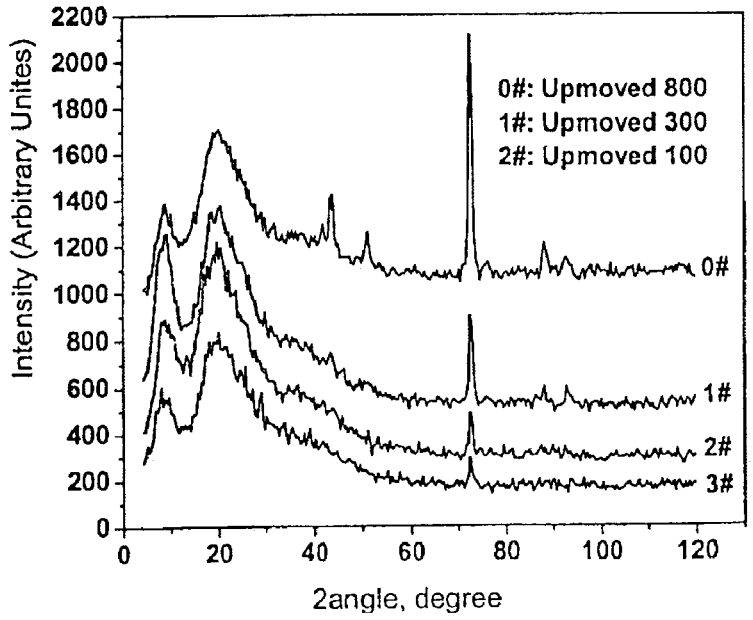

FIG. 9 shows the X-ray diffraction of the different samples #0 to #3. It is very evident that as the size of the fiber particle decreases, the intensity of crystal peaks, the peak intensity and enclosed area decrease. The crystallinity from the original fiber #0 to sample 3# is 50.7%, 35.9%, 33.7% and 29.7% respectively. This shows grinding of the wool fibers greatly destroyed the crystal.

Figure 10:
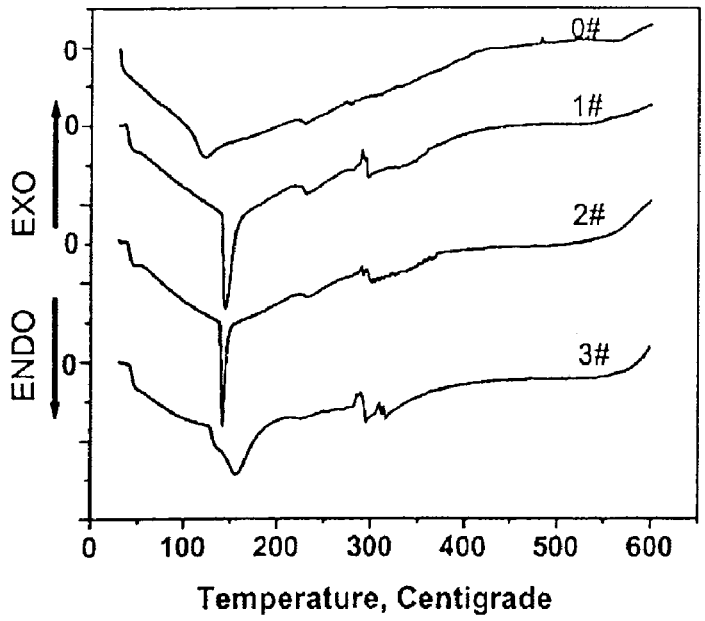
FIG. 10 is a differential scanning calonmeter curve of samples prepared in an apparatus according to the invention.

FIG. 10 shows the Differential Scanning Calorimeter (DSC) curve of the samples and they roughly correspond to two evident gravity loss. The four peaks can be explained as: peak 1 corresponds to the vaporization of bound water, peak 2 is ascribed to crystal cleavage (most evident in the original fibers: sample #0) and peak 3 corresponds to breakdown of crosslinks, such as —S—S— bonds, H bonds, salt links, that is denaturation, high temperature of peak 4 corresponds to the rupture of peptide bonds, leading to the liquefaction (most evident in sample #2 and sample #3) and it shows a very strong single endotherm corresponding to liquefaction of the crystal at 294–316.

Figure 11:
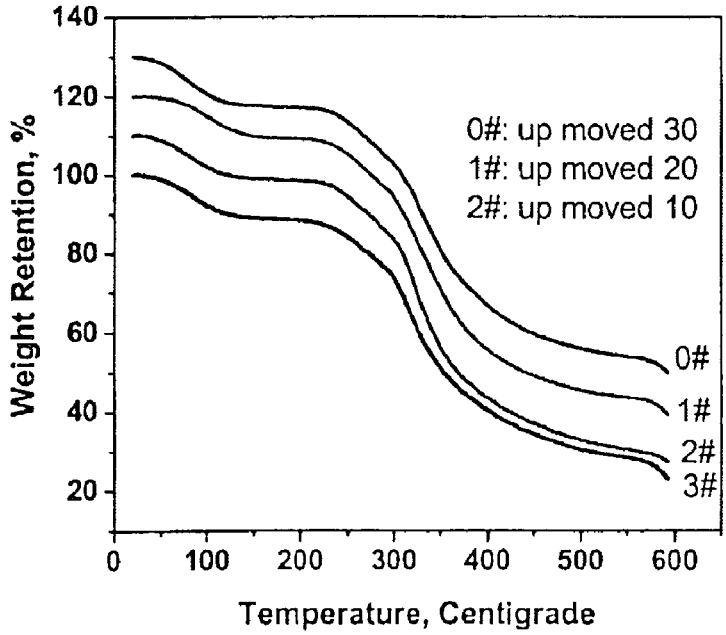
FIG. 11 is a thermogravimetric curve of samples prepared in an apparatus according to the invention.

FIG. 11 shows the Thermogravimetric (TG) curve. All samples are similar to each other in the weight loss during the elevated temperature. However, sample 3 shows evident high residue than other samples, weight of the residue of sample 0–2 were around 19%, and sample 3 remained around 20%. This confirms that during the longer grinding to obtain finer powder, the loss of non carbon elements in the formation such as H2S and NH3 was greater than other samples of large particle size, thus the relative retained carbon elements was more than other samples of large particle size.

Where in the foregoing description reference has been made to integers or elements have known equivalents then such are included as if individually set forth herein.

Embodiments of the invention have been described, however it is understood that variations, improvement or modifications can take place without departure from the spirit of the invention or scope of the appended claims.

What is claimed is:

1. An apparatus for grinding an organic material into a powder comprising:

a first grinding member with a concave grinding surface, and a second grinding member with a convex grinding surface including an apex at a center of the convex grinding surface, each of the concave and convex grinding surfaces including a plurality of radii defining a plurality of sectors, each sector including rows of teeth parallel to one of the radii defining the sector, wherein the first and second grinding members are rotatably positioned adjacent each other for grinding an organic material between the concave and convex grinding surfaces.

2. The apparatus of claim 1 wherein the first and second grinding surfaces are substantially conical.

3. The apparatus of claim 1 including a rotary driving means engaging the second member for rotation of the second grinding surface relative to the first grinding surface.

4. The apparatus of claim 1 further including troughs between the rows of teeth and defining chambers that increase and decrease in size with rotation of the second grinding member.

5. The apparatus of claim 1 wherein the first and second grinding surfaces are substantially parabolic.

* * * * *